United States Patent [19]

Moncrieff-Yeates

[11] 4,096,849

[45] Jun. 27, 1978

[54] FIREPLACE UNIT WITH SLOPING BED PLATE

[76] Inventor: Alexander John Moncrieff-Yeates, 8609 Hillside Pl., Fairfax, Va. 22030

[21] Appl. No.: 729,955

[22] Filed: Oct. 6, 1976

[51] Int. Cl.[2] ..... F24B 7/00

[52] U.S. Cl. ..... 126/121; 126/131; 126/143

[58] Field of Search ..... 126/120, 121, 130, 131, 126/143, 203, 202, 201, 298, 242, 243, 244

[56] References Cited

U.S. PATENT DOCUMENTS

| | | | |
|---|---|---|---|
| 994,980 | 12/1909 | Yarborough | 126/298 |
| 2,048,675 | 7/1936 | Baruch et al. | 126/132 |
| 2,375,318 | 5/1945 | Mudgett | 126/143 |
| 3,995,611 | 12/1976 | Nelson | 126/121 |

*Primary Examiner*—Ronald C. Capossela

*Attorney, Agent, or Firm*—Sixbey, Friedman & Leedom

[57] ABSTRACT

A fireplace unit wherein room air is circulated under the firebox bed plate has the bed plate sloped upwardly toward the rear to assist in convective flow of the room air.

To accommodate ash discharge, a chute depends from the elevated rear portion of the bed plate in registry with the conventional fireplace ash chute, and has its upper walls spaced from the bed plate at its front and rear portions to provide a cooling effect.

9 Claims, 3 Drawing Figures

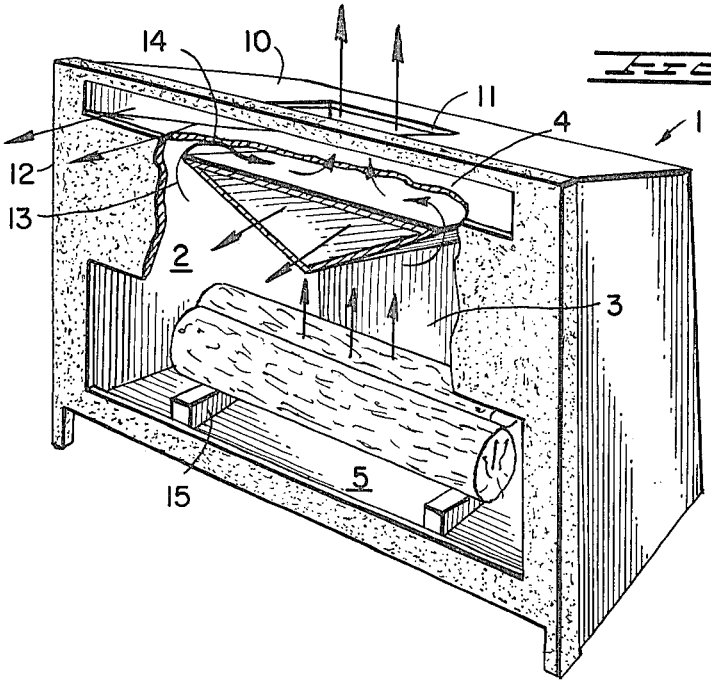
Fig. 1
Fig. 2.
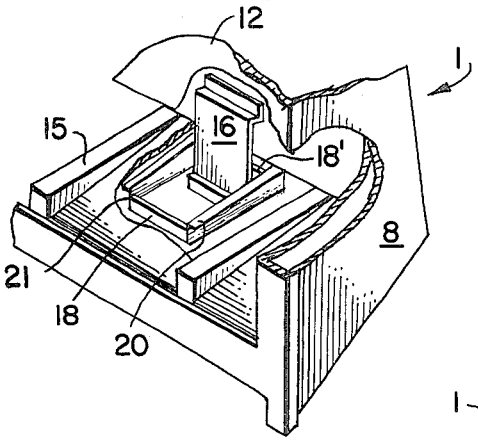
Fig. 3.
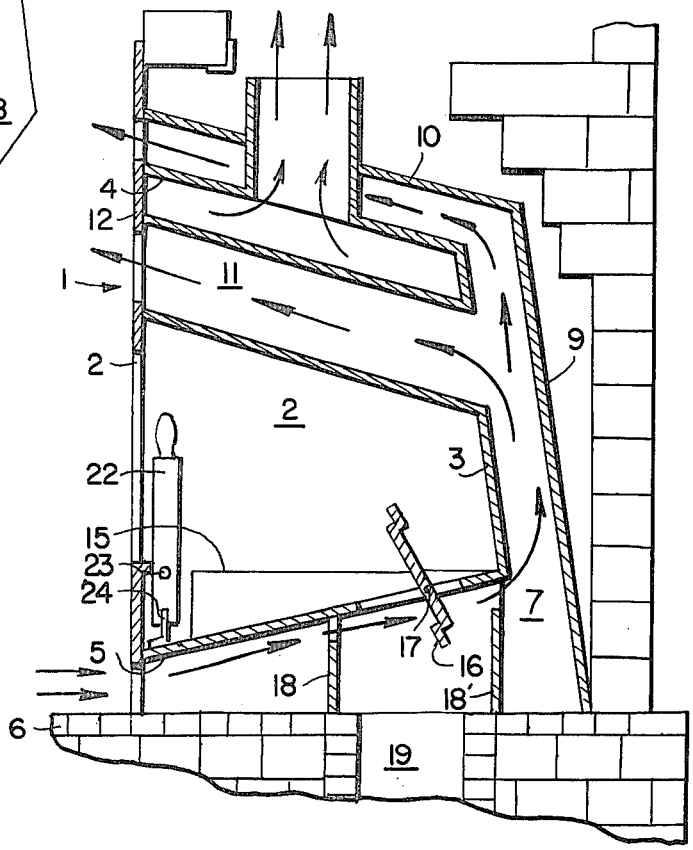

FIREPLACE UNIT WITH SLOPING BED PLATE

FIELD OF INVENTION

This invention relates to fireplace units of the recirculating room air type as examplified by my co-pending application Ser. No. 570,798, now U.S. Pat. No. 4,056,091, filed Apr. 23, 1975, and by U.S. Pat. No. 2,642,859, issued June 23, 1953 to N. T. Brown or to fireplaces including provision for heating air circulated in ducts leading to and from other points in a building, as seen in U.S. Pat. No. 3,096,754, issued July 9, 1963 to Harold C. Howrey.

BACKGROUND OF INVENTION

Previously known fireplace units which pull room air in under the fire enclosure bed are characterized by horizontal bed plates, as evident from the patents mentioned above. Ashes from a fire in such an enclosure accumulate on the horizontal bed plate, and can present contrasting detrimental effects depending upon the circumstances.

In a first circumstance, heavy accumulation of ashes on the horizontal bed plate serves as an insulative layer between the heat of the fire and the incoming room air. The result is a diminished heat exchange between fire and the incoming room air disposed under the bed plate. Consequently, this air remains cold, and the flow of this air to the upwardly disposed passages at the rear and sides of the unit is induced solely by the slight negative pressure resulting from the convective flow in those rear and side passages where the air is in good heat exchange relationship with the fire enclosure.

In a second circumstance where the horizontal bed plate is free of ash accumulation and hence subject to radiation from the fire, heat transfer through the bed plate to the underlying incoming room air remains inefficient because of the relatively low velocity thereof. This, in turn, has a detrimental (in fact, dangerous) result that the bed plate becomes overheated. In the past, designers have resorted to extra-thick bed plates in order to avoid burnouts, and thus incur additional cost in the construction and unnecessarily heavy units which increase shipping costs and render installation more difficult.

It has also been recognized in the past that it is desireable to provide an ash transfer duct passing from the bed plate through the underlying room air passageway to a point of registry with the conventional ash chute of the fireplace hearth. In previously known structure, this duct completely isolates the area of the trap door for ashes from any heat exchange with underlying room air, and accentuates the liklihood of burn-out in that area.

OBJECTS OF INVENTION

In contradistinction to the aforedescribed previously known structures, it is among the objects of this invention to provide a fireplace unit of the recirculating room air type in which 1. the bed plate is sloped upwardly and rearwardly to provide convective flow of the underlying incoming room air,
2. A greater proportion of incoming room air is channeled away from the side passages and to the vertical passage in the rear of the unit,
3. heat exchange through the bed plate is enhanced,
4. weight of the unit is materially reduced,
5. cost of materials is reduced, 6. an ash duct is provided which does not interfere with room air circulation, and
7. an ash duct is provided which avoids overheating of the portion of the bed plate overlying the duct.

DESCRIPTION OF DRAWINGS

The aforestated objects, as well as other objects inherent in the fireplace unit of this invention, will be apparent from a consideration of the ensuing speficiation and drawings, in which FIG. 1 is a perspective of a fireplace unit of the room air circulating type, FIG. 2 is a fragmentary perspective of the unit of FIG. 1 with a portion of the sloping bottom cut away to reveal the ash chute detail, FIG. 3 is a cross-sectional view taken through the center of a fireplace including a unit of this invention.

DESCRIPTION OF INVENTION

Referring first to FIG. 1, this invention is depicted in a fireplace unit generally indicated at 1 which is of the type described and claimed in my aforementioned application Ser. No. 570,798, now U.S. Pat. No. 4,056,091. In this unit, a fire enclosure is defined by side walls including wall 2, rear wall 3, top wall 4, and a bed plate 5 which differs from my prior application in that it slopes upwardly and rearwardly in accordance with this invention.

The fire enclosure is surrounded by passages through which room air is circulated in heat exchange relationship with the enclosure. These passages include a room air intake passage underlying the bed plate 5 and defined by the bed plate 5 and the fireplace hearth 6. Other passages in communication with the room air intake passage to complete the room air circulation system include the unit exterior side walls 7, 8, exterior rear wall 9, and exterior top wall 10. A duct 11 extending through the enclosure rear wall and through the facade 12 of the unit completes the room air recirculating system by carrying a portion of the room air through the upper reaches of the fire enclosure. This duct and the specific geometry of the unit attain an enhanced heat exchange through the creation of a vortical flow pattern of hot combustion products in the areas indicated at 13 and 14 and fully described in my aforementioned pending application.

This particular fireplace unit is chosen for illustration here because of the importance in such a unit of channeling a substantial flow of room air to the rear passageway where it finds its way to the duct 11, but it should be recognized that this invention is equally applicable to fireplace units which are devoid of a duct such as duct 11. In either event, it can be seen that the provision of a bed plate 5 which slopes upwardly in the direction of underlying room air flow enhances the intake of room air by permitting an upward component of convective flow in the area underlying the bed plate. The upward slope of the bed plate could take many forms, including portions sloping to each of the vertical passageways of the room air recirculating system. In the preferred embodiment illustrated, this upward slope is toward the rear vertical passageway for reasons now to be discussed. In the prior art where convective flow is limited to the surrounding vertical passages and flow of the air underlying the horizontal bed plate is limited to that caused by the slight negative pressure developed by that convective flow in the vertical passages there is a marked tendency for the room air to take the shortest path under the bed plate to the vertical passages at the sides of the fire enclosure, rather than the relatively long path to the vertical passage at the rear. Not only does this result in a disproportionate flow being diverted from the highly heated rear wall 3, but in a unit which includes a central duct 11 it is desireable to route a high percentage of the flow up the rear passageway in order to provide a higher percentage of flow through the duct 11. Thus, it can be seen that this bed plate 5 which slopes upwardly to the rear at a preferred angle of 15° or less accomplishes several objectives, namely: (1) increased total flow through unit by creating convective flow under the bed plate, (2) distribution of a greater percentage of total flow to the rear vertical passageway of the unit, (3) enhancement of heat exchange through the bed plate, and facilitates use of lighter materials because of better heat exchange from the bed plate by virtue of the scrubbing action of the flowing incoming air.

In the latter regard, if the use of a lighter (i.e., thinner) bed plate is to be realized, it is essential that the scrubbing action of the underlying air be distributed over the entire bed plate surface. In units which include an ash chute, such as in Howry U.S. Pat. No. 3,096,754, a problem is created by reason of the interference with this air flow by the duct itself. The result is a hot spot in the bed plate at the area of the ash chute. To the end that this problem may be avoided, this invention provides a conventional trap door 16 pivotally mounted as at 17 in an ash opening in the bed plate 5. The trap door 16 overlies a conventional ash receiving chamber 19 in the hearth 6, and ashes which are discharged through the trap door 16 are directed to the chamber 19 by a chute having front and rear walls 18, 18' and side walls 21. The distance between front wall 18 and rear wall 18' is greater than the fore and aft dimension of the trap door opening and the walls 18, 18' terminate in an upper edge which is spaced from the bed plate 5. The side walls 21 extend upwardly to the bed plate 5 to provide a suspended mounting for the chute, and in the preferred construction illustrated are attached to the bed plate 5 by angle irons 20. The space between the upper edges of the front and rear walls 18, 18' provides openings for incoming room air to flow as indicated by the arrow in FIG. 3. The side walls 21, being aligned with the direction of air flow, provide negligable interference with air flow. The distance between the front and rear walls 18, 18' is great enough to avoid spillage of ash onto the hearth proper during ash discharge, which, incidentally, is enchanced by the tendency of ashes to accumulate on the forward portion of the bed plate 5 due to its slope, and thus avoid covering and obscuring the trap door.

The unobstructed flow of incoming room air not only avoids overheating of the bed plate 5 in the area of the ash chute (and rearwardly thereof), but also avoids interference with that portion of the flow which is destined to flow up the center of the rear wall 3 and to the duct 11, where maximum heat exchange is expected.

The sloping bed plate 5 of this invention may appropriately be provided with grates 15 extending fore and aft of the fire enclosure and adapted to the sloping contour of the bed plate and presenting a horizontal upper surface for support of the fuel. Alternatively, the upper surface may be contoured sloping downwardly to the rear or concavely to have their lowest point in the center. When the grates 15 are rigidly attached to the bed plate to provide reinforcement thereto, it may be desireable to provide andirons, which are movable in a side-to-side direction of the fire enclosure to accomodate various lengths of logs and to facilitate cleaning. Yet, inasmuch as the grates are elevated considerably above the hearth level, it is equally desireable that the andirons be firmly attached to the unit, as logs which might otherwise tumble from the grate would be likely to acquire sufficient momentum to cause them to roll beyond the hearth into the room. To this end, there is provided a horizontal rod 23 at a location between the grate and the fire enclosure opening and at a height approximately that of the top surface of the grate. Directly underlying the rod is a track 24, here shown as including an upstanding flange affixed to the bed plate 5. Each of two andirons 22 (omitted from FIG. 3 for purposes of clarity) comprise vertical tubular elements which include apertures for reception of the supporting rod 23 and a bifurcated lower extremety in registry with the guide track 24. It can be radily seen that each andiron 22 can be easily adjusted, and that once in position its weight and its frictional engagement with the rod and track 24 will hold it in position. The andirons are readily moveable to permit movement of ashes in front of the permanently affixed grates 15 during the process of discharge.

In compliance with 35 U.S.C. 112, this fireplace unit with sloping bed plate and ash chute has been described with reference to a preferred embodiment with no intention of so limiting the inventive concept, the scope of which should be determined by reference to the following claims.

What is claimed is:

1. In a fireplace unit of the type which includes room air circulating passageway including an incoming room air inlet extending substantially the full width of the unit, and opening into an inlet passageway underlying the bed plate of the fire enclosure, at least one vertical passageway defined in part by a wall of said fire enclosure, and an air outlet to a room, the improvement wherein said bed plate is sloped upwardly in the direction of flow of incoming air in the underlying passageway as it flows toward said air outlet.

2. The fireplace unit of claim 1 wherein the upward slope of said bed plate is in the direction rearwardly in said unit.

3. The fireplace unit of claim 2 including spaced stationary grates extending fore an aft of said bed plate and rigidly affixed thereto throughout their fore and aft dimensions, said grates terminating short of the forward edge of said bed plate.

4. The fireplace unit of claim 1 wherein said room air recirculating passageways include at least one vertical passageway defined in part by a wall of the fire enclosure, a heated air duct communicating with at least one said vertical room air circulating passageway through a connection therewith at a level above said inlet passageway and extending through the upper reaches of said fire enclosure to an outlet to the room, the said upward slope of said bed plate facilitating convective flow of the incoming air in the underlying passageway as it flows toward said air duct connection to said passageway.

5. The fireplace unit of claim 1 wherein said bed plate includes a trap door for ash disposal, an ash chute suspended from said bed plate in a position underlying said trap door, said chute including diametrically opposite walls having openings communicating with said room air inlet passageway in the direction of slope of said bed plate, said openings being disposed subjacent to the bed plate to permit flow of incoming room air transversely of said chute through both said openings.

6. The fireplace unit of claim 5 wherein said front and rear walls terminate in upper edges spaced from said bed plate to define said openings.

7. The fireplace unit of claim 5 wherein said room air circulating passageways include a rear vertical passageway defined in part by a rear wall of the fire enclosure and a heated air discharge duct communication with said rear vertical passageway and extending forwardly through said fire enclosure to a point of discharge open to the room, said ash discharge chute being disposed directly under the point of communication of said heated air discharge duct with said rear vertical passageway.

8. The fireplace unit of claim 1 including andirons, means mounting said andirons to said unit for side to side movement in a path across the front portion of the fire enclosure at the front of said bed plate.

9. The fireplace unit of claim 8 wherein said mounting means comprises a horizontal rod which extends across at least a portion of the front of said enclosure in a position spaced above the bed plate, and said mounting means further comprises a guide track which extends across at least a portion of the front of said bed plate at approximately the level thereof, and each said andiron includes means registering with said rod and with said guide track to permit movement therealong.

* * * * *